United States Patent [19]

Shaw

[11] 4,242,068

[45] Dec. 30, 1980

[54] VANE PUMP WITH BYPASS FOR LEAKAGE OF FLUID WHEN BOTTOM OF VANE IS CONNECTED TO UNDERVANE SUCTION PORT

[75] Inventor: Edwin L. Shaw, Delaware, Ohio

[73] Assignee: Abex Corporation, New York, N.Y.

[21] Appl. No.: 965,631

[22] Filed: Dec. 1, 1978

[51] Int. Cl.[3] ..... F04C 2/356

[52] U.S. Cl. ..... 418/269; 418/82

[58] Field of Search ..... 418/82, 180, 267–269; 417/204

[56] References Cited

U.S. PATENT DOCUMENTS

| | | | |
|---|---|---|---|
| 3,359,914 | 12/1967 | Adams et al. | 418/269 |
| 3,645,647 | 2/1972 | Ciampa et al. | 418/267 |
| 3,781,145 | 12/1973 | Wilcox | 418/82 |
| 3,790,314 | 2/1974 | Swain et al. | 418/82 |

*Primary Examiner*—John J. Vrablik

*Attorney, Agent, or Firm*—Thomas S. Baker, Jr.; David A. Greenlee

[57] ABSTRACT

The instant invention provides an improved vane for a vane pump which incorporates an extended undervane suction port. The vane has a restricted passage which connects the inner and outer ends of the vane and an unrestricted passage which connects the outer end of the vane and the suction side of the vane when the leading edge of the vane is exposed to the pressure port and the inner end of the vane is connected to the suction port.

2 Claims, 8 Drawing Figures

VANE PUMP WITH BYPASS FOR LEAKAGE OF FLUID WHEN BOTTOM OF VANE IS CONNECTED TO UNDERVANE SUCTION PORT

BACKGROUND OF THE INVENTION

1. Field of the Invention

This invention relates to an improvement in a vane type hydraulic pump which comprises a rotor, a stator, vane slots in one of the rotor or stator, and vanes in the vane slots which sequentially traverse an intake or suction zone, a transfer zone, a pressure or exhaust zone and a sealing zone when the pump is operated. More specifically, the invention relates to an improved vane structure for a pump which incorporates an extended undervane suction port.

2. Description of the Prior Art

Conventional two-lip, solid vanes are well known in the art and are commonly used in vane pumps. As these vanes traverse the transfer zone on the major diameter of the cam ring, the leading face is exposed to high pressure fluid from the pressure port and the pressure fluid tends to leak across the leading lip or edge of the vane. This leakage creates a high pressure on top of the vane which tends to bias the vane inwardly of the vane slot and away from the cam ring. Separation of the vane from the cam ring is potentially disastrous, since it provides a short circuit path for high pressure fluid to reach the low pressure zone behind the vane.

To overcome the force acting to bias the vane inwardly as it traverses the transfer zone, springs or hydraulically operated pins are placed in the bottom of the vane slot to bias the vane outwardly. A problem with using a spring or a hydraulic pin to bias a solid vane is that, when the pressures on the inner and outer ends of the vane are equal, as when it traverses the pressure and suction zones, the force exerted by the spring or pin is considerably in excess of what is needed to maintain the vane in contact with the cam ring. As a result, the edges of the vane and cam ring wear at a relatively high rate.

To overcome some of the problems associated with a solid two-lip vane, passages were formed in the vane, which passages connected the inner and outer ends of the vane. Such passages are shown in U.S. Pat. No. 3,359,914 to Adams, which is assigned to the assignee of the instant invention. The purpose of the passages is to equalize or balance the pressure on the inner and outer ends of the vane at all times. With a balanced vane a reduced spring or pin force is required to maintain a vane in contact with the cam ring. This greatly reduces vane and cam ring wear.

The above-mentioned Adams' patent also purported to solve the problem of reduced pump efficiency caused by high pressure fluid leaking past the leading edge of the vane as it traversed the transfer zone. In Adams it is theorized that this leakage fluid produces a turbulence in the low pressure zone immediately behind the vane which adversely affects the filling of the intervane space. In order to reduce this turbulence, high pressure fluid which leaks over the leading edge is forced through a tortuous path formed in the vane to reduce the velocity of the fluid. Subsequently, the low velocity fluid is routed to the back of the vane.

Balanced vanes which permit the free flow of fluid between the inner and outer ends encounter difficulty when the pump is run at relatively high speeds. When the vane traverses the pressure zone it is moved inwardly in the vane slot by the inwardly inclined pressure ramp on the cam ring. Since the inner and outer ends of the vane are connected, the inward movement of the vane is not resisted by fluid pressure under the vane. It is only resisted by the springs or pins under the vane. At high speeds the momentum of the vane is such that the vane continues to travel inwardly after it reaches the end of the pressure ramp. Thus, it skips or loses contact with the initial portion of the minor diameter. The vane is subsequently snapped back against the cam ring by the springs or pins, but wear of the cam ring and vane edges is increased from the vane striking the cam ring.

One way to prevent the vane from skipping at the end of the pressure ramp is to provide very heavy spring or pin forces to bias the vane outwardly. These heavy forces will, however, cause accelerated wear of the vane edges and the cam ring.

The tendency of vanes to move inwardly past the end of the pressure ramp at high pump speeds and skip the initial portion of the minor diameter was substantially reduced by the improvements shown in U.S. Pat. No. 3,781,145 to Wilcox, which is assigned to the assignee of the instant invention. Wilcox discloses inserting a flow restricting orifice in the fluid passage which connects the inner and outer ends of the vane. Inward movement of the vane in its rotor slot as the vane traverses the pressure zone causes fluid to be displaced from the inner end of the vane slot through the orifice to the outer end. As the fluid flows through the orifice, a pressure differential arises and an outward directed force is created at the inner end of the vane which resists inward movement of the vane. Consequently, the pump can operate at higher speeds before the vane begins to skip at the end of the pressure ramp.

Vanes with the flow restricting orifices, described in the Wilcox patent, have been used in vane pumps having extended undervane suction ports which are described in U.S. Pat. No. 3,790,314 to Swain and assigned to the assignee of the instant invention. The purpose of an extended undervane suction port is to provide fluid communication between the inner end of each vane slot, angularly, beyond the end of the main suction port. Ideally, the undervane suction port extends toward the pressure port to a position just short of the point where it would provide a short circuit connection between the pressure and suction ports. The primary advantage of the undervane suction port is that it provides improved filling of the intervane pocket and enables the pump to operate satisfactorily at higher speeds.

In a pump which has extended undervane suction ports, the top of the vane is beyond the suction port while the bottom of the vane remains connected to the undervane suction port for a number of degrees of travel as the vane traverses the transfer zone. Shortly after passing the suction port and while the bottom of the vane is connected to the undervane suction port, the vane is exposed to high pressure fluid. During this time, any pressure fluid which leaks across the leading edge of the vane will flow inwardly through the vane past the restrictors, since the fluid at the outer end of the vane is at higher pressure than the fluid at the inner end. As the fluid flows through the orifice, a pressure differential arises and an inwardly directed force is created which tends to move the vane inwardly of its slot and away from the cam ring. This inward force lasts until the inner end of the vane is disconnected from the undervane suction port.

The problem associated with the extended undervane suction port could be eliminated by removing the extended undervane suction port. However, this is unacceptable since it provides a tremendous increase in the performance of the pump. Another solution is to take the orifice out of the passage which connects the inner and outer ends of the vane. This is undesirable since the advantage of the dash pot effect at the end of the pressure ramp which enables the vane to track the cam ring at higher pump speeds is lost. Of course, stronger springs or increased pin force could be resorted to, but these increase the wear of the vanes and cam ring.

Consequently, it is desirable to provide a pump which includes extended undervane suction ports and vanes with restricted passages which connect the inner and outer ends, which do not require large spring or pin forces and which do not permit pressure fluid leaking across the leading edge of the vane to push the vane away from the cam ring during the time the bottom of the vane is connected to the undervane suction port and the top of the vane is exposed to high pressure fluid.

SUMMARY OF THE INVENTION

The instant invention provides a vane pump with undervane suction ports, an orifice in the fluid passage connecting the inner and outer ends of the vane and a bypass hole in the trailing face of the vane which is connected to the fluid passage upstream of the restriction. The purpose of the bypass hole is to provide a path to the low pressure zone behind the vane for the pressure fluid which leaks across the leading edge of the vane when the vane is exposed to high pressure fluid without having the fluid flow through the orifice to the inner end of the vane when it is connected to the undervane suction port.

DESCRIPTION OF THE PREFERRED EMBODIMENT

Figure 2:
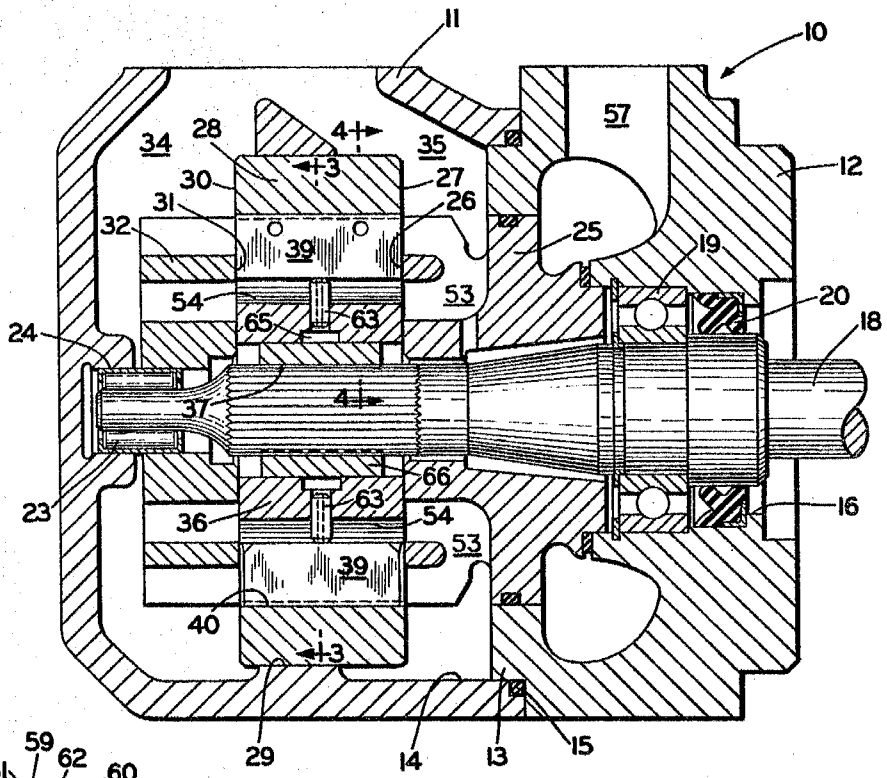
FIG. 2 is an axial section taken along line 2—2 of FIG. 1.
Figure 1:
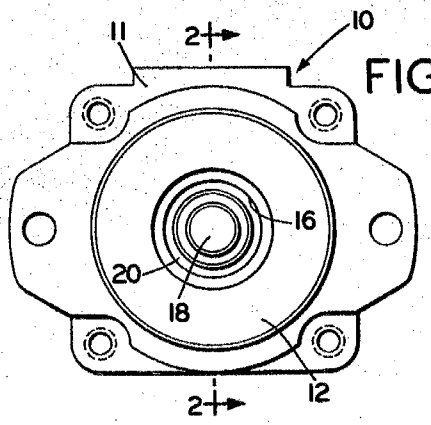
FIG. 1 is an end elevation of the vane pump of this invention.
Figure 5:
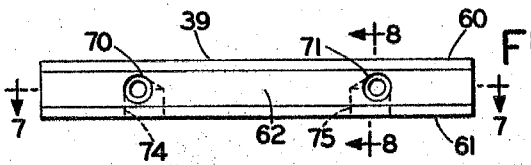
FIG. 5 is a top plan view of an improved vane of the instant invention.
Figure 6:
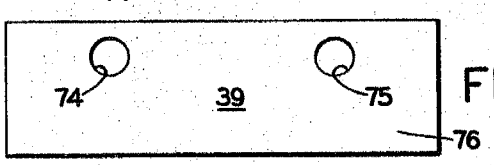
FIG. 6 is a side elevational view of the vane of FIG. 5.
Figure 7:
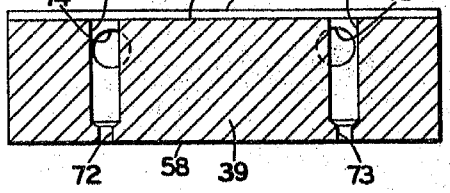
FIG. 7 is a transverse sectional view taken along line 7—7 of FIG. 5.
Figure 8:
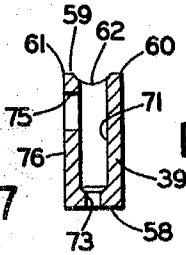
FIG. 8 is a sectional view taken along line 8—8 of FIG. 5.
Figure 3:
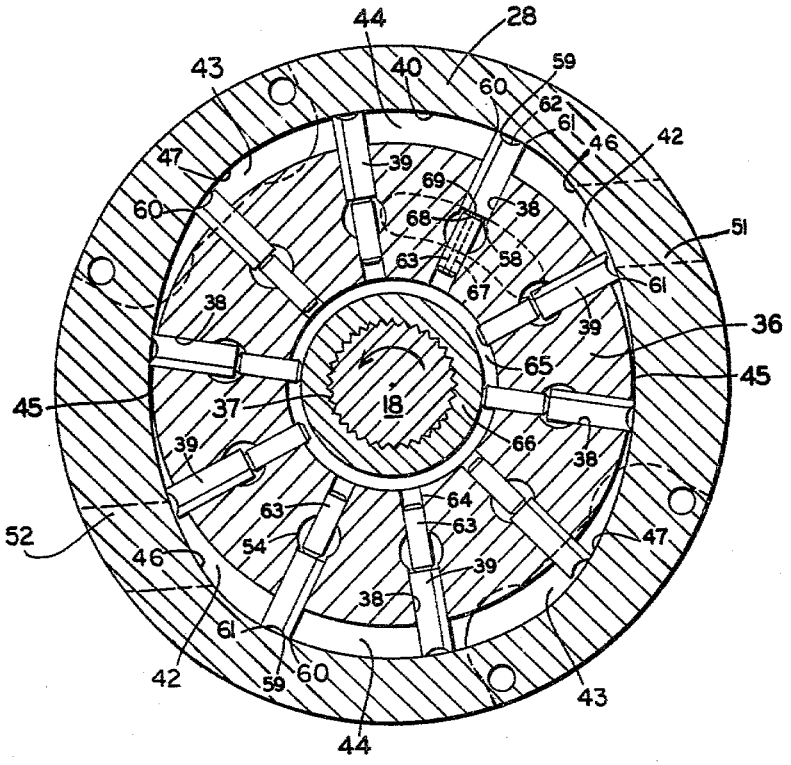
FIG. 3 is a transverse sectional view taken along line 3—3 of FIG. 2.

Referring to FIGS. 1-3, the vane pump 10 of the instant invention includes a housing formed by the cooperation of a main body casting 11 and an end cap 12. End cap 12 has an annular projection 13 which is received in a mating bore 14 in one end of body 11 and is sealed with respect to the body 11 by an O-ring 15. End cap 12 is secured to body 11 by bolts, not shown.

End cap 12 has a central opening 16 which receives a drive shaft 18. Drive shaft 18 is supported for rotation in end cap 12 by a bearing 19 which is secured against axial movement. A seal 20 prevents fluid leakage along shaft 18. Drive shaft 18 projects through the main portion of body 11 and is supported at its outer end by a bearing 23 which is mounted in an annular bore 24, formed in the inner wall of body 11.

A front cheek or port plate 25 is supported in end cap 12. Port plate 25 has a smooth, flat inner surface 26 which bears against one side 27 of an annular cam ring 28, which is supported in a central annular rib 29 in body 11. The opposite side 30 of cam ring 28 bears against a smooth, flat surface 31 on a rear port plate 32, and holds the latter against an internal shoulder, not shown, in body 11. Cam ring 28 and port plates 25, 32 are clamped together by bolts, not shown.

The vane pump 10 has a fluid intake passage which extends into body 11 and communicates with a pair of annular passageways 34, 35 located on each side of cam ring support rib 29. Inside of cam ring 28 is a rotor 36 which is driven by drive shaft 18 through a splined connection 37. The rotor 36 has a plurality of slots 38 each of which receives a vane 39.

Figure 4:
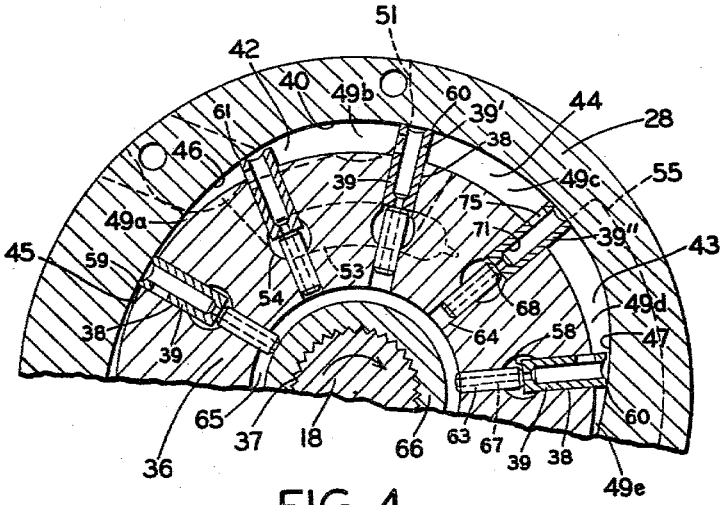
FIG. 4 is a sectional view taken along line 4—4 of FIG. 2.

Cam ring 28 has a smooth inner surface 40 that is contoured to provide a symmetrical pump construction in which there are pairs of diametrically opposed, low pressure, inlet or suction zones 42 and high pressure, outlet or exhaust zones 43, which can be seen in FIGS. 3 and 4. For each 180° of rotor rotation, each vane sequentially traverses a suction zone 42, a transfer zone 44, an exhaust zone 43 and a sealing zone 45. Cam surface 40 recedes from the rotor 36 in the suction zone 42 forming a suction ramp 46 which terminates at the greatest distance from the rotor 36 which is the beginning of the transfer zone 44. Transfer zone 44 is formed on the major diameter of the cam ring 28. At the end of the transfer zone 44 the cam ring surface 40 moves toward rotor 36, forming a pressure ramp 47 which terminates at the closest distance from the rotor at the sealing zone 45. The sealing zone 45 is formed on the minor diameter of the cam ring 28.

Pairs of adjacent vanes divide the annular pumping space between the rotor 36, cam ring surface 40 and port plates 25, 32 into a series of intervane pockets or spaces which are designated **49*a*, 49*b*, 49*c*, 49*d*, 49*e* in FIG. 4. Low pressure fluid in the annular passageways 34, 35 communicates through passages in the port plates 25, 32 with paired main suction ports 51, 52 spaced 180° apart and formed in port plate surfaces 26, 31 adjacent the suction zones 42. In other words, the suction ports 51 52 are formed in both port plates 25, 32 so that each port communicates with opposite sides of the rotor 36. The suction ports 51, 52 are aligned with the suction zones 42**.

Each main suction port 51, 52 is connected by a passage, not shown, with an undervane suction port 53, one of which is shown in FIG. 4. The undervane suction ports 53 are positioned radially so that they open into the inner end 54 of the vane slots 38 as the rotor turns. The use of undervane suction ports is conventional in the art and may be of the design shown in U.S. Pat. No. 3,790,314 to Swain.

Referring to FIGS. 2-4, two diametrically opposed pressure ports 55 are formed in the front port plate 25. These ports are located circumferentially approximately 90° from the suction ports 51, 52 and open into the pressure zone 43. The pressure ports 55 are connected through internal passages, not shown, in port plate 25 to a fluid outlet passage 57 in end cap 12 which delivers the high pressure fluid to an external hydraulic circuit.

Referring to FIGS. 3 and 4 where the indicated direction of rotation is clockwise, the outer end 59 of each vane 39 has a leading lip or edge 60 and a trailing lip or edge 61, which edges are separated by a groove 62. In operation, one of the edges 60, 61 is in contact with the smooth, inner surface 40 of cam ring 28 at all times. In the suction zone 42, the trailing edge 61 of vane 39 engages surface 40 by reason of the outwardly sloped suction ramp 46, while the front or leading lip 60 will engage the cam surface 40 in the pressure zone 43 by reason of the inwardly sloped ramp 47. In the transfer zone 44, there is also a slight inward slope on the cam ring surface 40 which is engaged by leading edge 60. In the sealing zone 45 both of the vane edges 60, 61 engage the cam ring surface 40.

In the instant invention, each vane 39 is biased outwardly of its slot 38 by a hydraulically operated piston 63 which slides in a bore 64 which is beneath and axially aligned with vane slot 38. The bores 64 are interconnected at their inner ends by an annular pressure chamber 65. Fluid can flow into and out of chamber 65 only through the bores 64, since the inner end of chamber 65 is defined by a sleeve 66 which is pressed onto drive shaft 18. Each piston 63 has an axial bore 67 and a conical portion 68 which terminates in a flat end portion 69 which engages the inner end 58 of a vane 39. The operation of the hydraulically operated piston 63 is fully described in U.S. Pat. No. 3,223,044 which is assigned to the assignee of the instant invention.

Each vane 39 has a pair of bores 70, 71 which connect the inner and outer ends 58, 59, respectively. The purpose of the bores 70, 71 is to balance the pressures at the inner and outer ends 58, 59 of the vane 39 at all times in order to reduce the force the piston 63 must exert on the vane 39 to maintain the vane 39 in contact with cam ring surface 40.

Each bore 70, 71 has a restrictor 72, 73, respectively, located adjacent the inner end 58 of the vane. The restrictors 72, 73 are short in relation to the length of the bores 70, 71 and have a substantially reduced cross-sectional area. The purpose of putting restrictors 72, 73 in the bores 70, 71 is to create a force tending to bias the vane 39 into contact with surface 40. When fluid flows through the restrictors 72, 73 in the direction from the inner end 58 to the outer end 59 of vane 39, as when the vane 39 traverses the pressure ramp 47, a pressure differential arises which creates a net outward force which acts on the inner end 58 of the vane. This force resists inward movement of the vane 39 and prevents the momentum of the vane 39 from carrying it inward beyond the end of the pressure ramp so that it disengages the cam ring surface 40 at the beginning of the sealing zone 45.

Referring to FIG. 4, it can be seen that after the vane 39′ at the rear of the intervane space 49*c* in the transfer zone passes beyond suction port 51, the undervane suction port 53 remains connected with the inner end 54 of vane slot 38. When the leading vane 39″, which defines the space 49*c*, reaches the end of the transfer zone it enters the pressure zone 43 and high pressure fluid fills the intervane space 49*c*. Some of the high pressure fluid in the space 49*c* leaks across the leading edge 60 of the vane 39′ at the rear of the space 49*c*. Previously, this high pressure fluid was allowed to flow inwardly of the vane through bores 70, 71 and restrictors 72, 73, respectively. Since the inner end 54 of each vane slot 38 is connected to suction pressure through the undervane suction port 53, a pressure drop is created across the restrictors 72, 73 by the flow of the high pressure leakage fluid therethrough. The effect of the pressure drop across the restrictors 72, 73 is to create a higher pressure on top of the restrictors 72, 73 than on the bottom with the result that a first force is created which tends to bias the vane 39 inwardly of the slot 38 away from cam surface 40.

As the leading edge 60 of the vane 39 wears, more area on the outer end of the vane is exposed to high pressure fluid and a second force acting to bias the vane 39 inwardly arises. It has been found that when the pump 10 is new and the leading edge 60 of each vane 39 is sharp and well defined, the combination of the first and second forces is not sufficient to bias the vane away from the cam ring surface. However, when the leading edge 60 of the vane wears a relatively small amount, the second force becomes large enough that the combination of the first and second forces is sufficient to bias the vane away from the cam ring surface 40. This makes the operation of the pump unsatisfactory and makes it necessary to dismantle the pump and replace the vanes.

In the instant invention, a pair of lateral bypass holes 74, 75 are bored in the rear face 76 of each vane 39, which holes 74, 75 intersect the vane bores 70, 71, respectively. Each of the bypass holes 74, 75 is approximately the size of the respective bores 70, 71 and is located near the outer end 59 of the vane. It is essential to make the holes 74, 75 substantially larger than the restrictors 72, 73.

The purpose of the bypass holes 74, 75 is to provide an alternate path for the high pressure fluid which leaks across the leading edge 60 of the vane 39 during the time the leading edge 60 is exposed to high pressure fluid and the inner end 58 of the vane is connected to the undervane suction port 53. When high pressure fluid leaks past leading edge 60 it flows through bores 70, 71, and then holes 74, 75. Since the holes 74, 75 are substantially the same size as the bores 70, 71 there is no pressure drop and no first force is created which tends to bias the vane 39 away from the cam ring surface 40. It has been found that with the holes 74, 75 formed in a vane 39 as described above, the leading edge 60 of the vane can wear quite severely before the second force is sufficient to bias the vane away from the cam ring surface 40. In fact, it has been found that pumps which incorporate the above described vanes can operate 2½ to 4 times longer before they must be overhauled and the vanes replaced as opposed to operating the pumps with vanes which do not have the bypass holes 74, 75.

At first glance it would appear that the use of the bypass holes 74, 75 would defeat the purpose and operation of the restrictors 72, 73. However, the purpose of the restrictors 72, 73 is to restrict inward movement of the vane 39 as it traverses the pressure ramp 47. During this time the fluid flows through the restrictors 72, 73 from the inner end 58 of the vane 39 towards the outer end 59 and the bypass holes 74, 75 have no effect.

When the vane 39 traverses the sealing zone 45 the bypass holes 74, 75 are covered inside the vane slot 38. Consequently, there is no short circuiting of fluid across the bypass holes.

From the above it can be seen that the bypass holes 74, 75 function only during the time a vane 39 traverses the transfer zone 44, has its inner end 58 connected to the undervane suction port 53 and its leading edge 60 exposed to high pressure fluid. At all other times the bypass holes 74, 75 have no effect on the function of the vane 39.